US007008266B2

(12) United States Patent
Fang

(10) Patent No.: US 7,008,266 B2
(45) **Date of Patent: *Mar. 7, 2006**

(54) MINI DIN CONNECTOR HAVING A REDUCED HEIGHT ABOVE A PRINTED CIRCUIT BOARD

(75) Inventor: HeSheng Fang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/875,630

(22) Filed: Jun. 23, 2004

(65) Prior Publication Data

US 2004/0235350 A1 Nov. 25, 2004

Related U.S. Application Data

(63) Continuation of application No. 10/313,241, filed on Dec. 5, 2002, now Pat. No. 6,764,338.

(30) Foreign Application Priority Data

Oct. 4, 2002 (TW) ..... 91215781 U

(51) Int. Cl.
*H01R 13/648* (2006.01)

(52) U.S. Cl. ..... 439/607

(58) Field of Classification Search ..... 439/607, 439/608, 609, 541.5
See application file for complete search history.

(56) References Cited

U.S. PATENT DOCUMENTS

| | | | | |
|---|---|---|---|---|
| 4,637,669 | A | 1/1987 | Tajimal | |
| 4,913,664 | A | 4/1990 | Dixon et al. | |
| 6,109,966 | A * | 8/2000 | Chiou | 439/607 |
| 6,227,904 | B1 * | 5/2001 | Wang et al. | 439/541.5 |
| 6,482,045 | B1 | 11/2002 | Arai | |
| 6,764,338 | B1 * | 7/2004 | Fang | 439/607 |

* cited by examiner

*Primary Examiner*—Alexander Gilman
(74) *Attorney, Agent, or Firm*—Wei Te Chung

(57) ABSTRACT

A mini DIN connector (1) comprises an insulative housing (10) defining a plurality of terminal passageways (112), a plurality of terminals (20), an inner shell (40), an outer shell (50) and a spacer (30). Each terminal has a mating portion (21) received in the terminal passageway, a transitional portion (22) extending upwardly from the rear end of the mating portion, a connect portion (23) extending rearwardly from the top end of transitional portion and a tail portion (24) bent from the end of the connect portion and extending downwardly. The inner and the outer shells are assembled to the insulative housing. The spacer defines a number of first grooves (310) and second grooves (320). Each second groove is communicated with a corresponding first groove. When the spacer is assembled to the housing, the connect portions and the vertical portions of the terminals are received in the first grooves and the second grooves of the spacer respectively.

6 Claims, 5 Drawing Sheets

MINI DIN CONNECTOR HAVING A REDUCED HEIGHT ABOVE A PRINTED CIRCUIT BOARD

CROSS-REFERENCE TO RELATED APPLICATIONS

This is a continuation application of a patent application Ser. No. 10/313,241, filed on Dec. 5, 2002 now U.S. Pat. No. 6,764,338.

BACKGROUND OF THE INVENTION

1. Field of the Invention

The present invention relates to a mini DIN (Deutsche Industrie Normen) connector, and especially to a mini DIN connector having a reduced height above a printed circuit board and a spacer assembled to an insulative housing thereof.

2. Description of Related Art

A conventional mini DIN connector comprises a dielectric housing having a mating face. An annular recess is defined in the mating face and a circular portion extends into the recess. The circular portion defines a plurality of terminal passageways extending therethrough and receiving a plurality of terminals therein. U.S. Pat. Nos. 4,637,669, 5,035,651, and 5,041,023 each disclose such a connector. When the connectors of the above-mentioned patents are mounted to printed circuit boards, the whole connectors are located above the printed circuit boards, which is undesirable in the circumstance where the heights of the components above the printed circuit board are limited.

One solution for the above issue is to provide an electrical connector which is partly located below a printed circuit board when the connector is mounted on the printed circuit board. However, the connector also has several disadvantages to overcome. First, the terminals of the connector are soldered to the printed circuit board by Surface Mounting Technology (SMT). The SMT requires expensive machine, thereby increasing the manufacturing cost of the connector. Second, the connector has no spacer for retaining the solder portions of the terminals, so the solder portions of the terminals are not positioned accurately and the electrical connecting between the printed circuit board and the connector is unreliable.

Hence, an improved electrical connector is desired to overcome the disadvantages of the prior art.

SUMMARY OF THE INVENTION

An object of the present invention is to provide a mini DIN connector having a reduced height above a printed circuit board and a spacer for retaining tail portions of terminals thereof.

To achieve the above object, a mini DIN connector in accordance with the present invention comprises an insulative housing defining a plurality of terminal passageways, a plurality of terminals, an inner metallic shell, an outer metallic shell, and a spacer. Each terminal has a mating portion received in the terminal passageway, a transitional portion extending upwardly from the rear end of the mating portion, a connect portion extending rearwardly from the top end of the transitional portion and a tail portion extending downwardly from the rear end of the connect portion. The inner and the outer shells are assembled to the insulative housing. The spacer defines a plurality of horizontal grooves and vertical grooves. Each vertical groove is communicated with a corresponding horizontal groove. When the spacer is assembled to the housing, the connect portions and the tail portions of the terminals are received in the horizontal grooves and the vertical grooves of the spacer respectively, so the tail portions of the terminals can be positioned accurately.

Other objects, advantages and novel features of the invention will become more apparent from the following detailed description when taken in conjunction with the accompanying drawings.

DETAILED DESCRIPTION OF THE INVENTION

Figure 1:
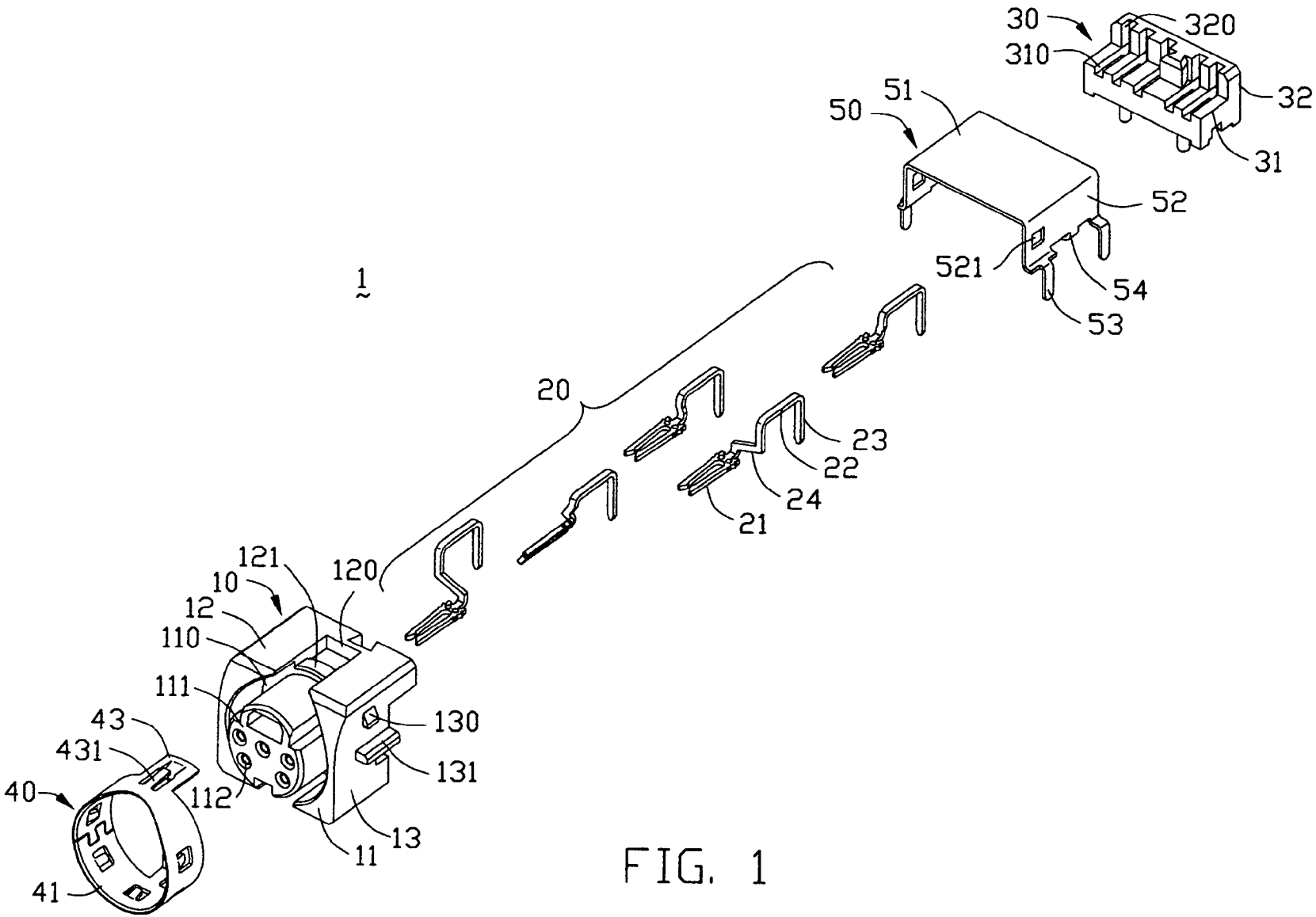
FIG. 1 is an exploded perspective view of a mini DIN connector in accordance with the present invention.
Figure 2:
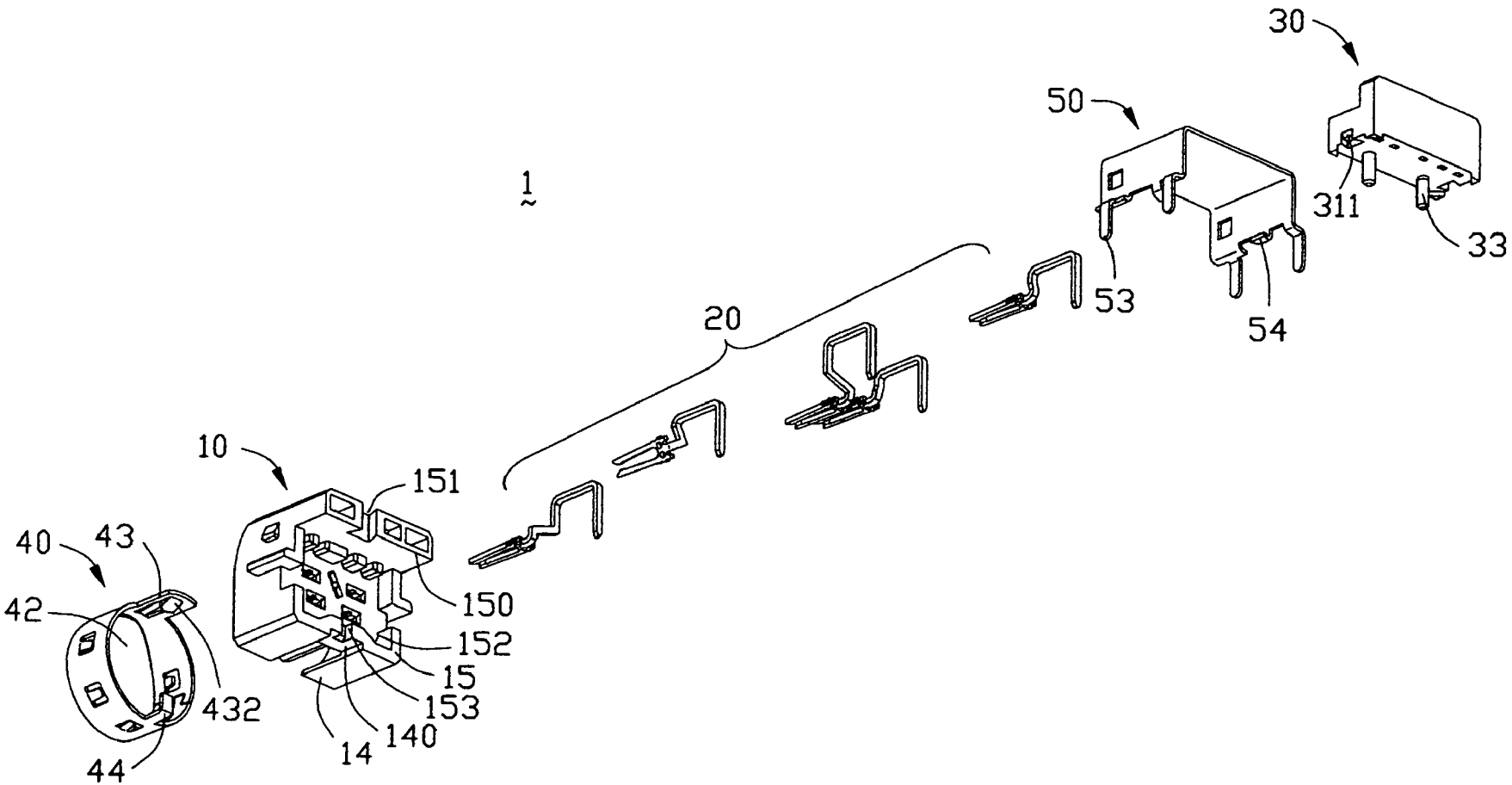
FIG. 2 is a view similar to FIG. 1 but taken from a different perspective.

Referring to FIGS. 1–2, a mini DIN connector 1 in accordance with the present invention comprises an insulative housing 10, a plurality of terminals 20, a spacer 30, an inner metallic shell 40 and an outer metallic shell 50.

The insulative housing 10 has a mating face 11, a top face 12, two opposite lateral faces 13, a bottom face 14 opposite to the top face 12, and a rear face 15 opposite to the mating face 11. The mating face 11 has a rearwardly curved configuration around a junction between the top face 12 and the mating face 11. The insulative housing 10 defines an annular recess 110 extending rearwardly from the mating face 10 for receiving a shell member of a mating connector (not shown), and is formed with a cylindrical mating portion 111 extending in the recess 110 and substantially beyond the mating face 11 at a front end thereof. The mating portion 111 defines a plurality of terminal passageways 112 extending through the length thereof and through the rear face 15 of the insulative housing 10.

The top face 12 of the insulative housing 10 defines a rectangular notch 120 in communication with the recess 110. A stop block 121 protrudes into the notch 120 and is located adjacent to a rear end of the mating portion 111. Each lateral face 13 is formed with a projection 130 and a support portion 131 below the projection 130. The bottom face 14 defines a rectangular notch 140 therein. The notch 140 is communicated with the recess 110 and extends through the rear face 15 of the insulative housing 10.

A flat roof 150 extends rearwardly from the upper portion of the housing 10. A cutout 151 is defined at the rear edge of the flat roof 150. The insulative housing 10 defines a cavity 152 below the flat roof 150. A plurality of spaced bumps 153 protrude into the cavity 152 from below the flat roof 150 and a plurality of spaces 154 are formed between the bumps 153 or between the bump 153 and the side wall of the cavity 152. A gap 155 is defined in the bottom wall of the cavity 152 and is communicated with the notch 140 in the bottom face 14 of the insulative housing 10.

Each terminal 20 includes a mating portion 21, a transitional portion 22 extending upwardly from the rear end of the mating portion 21, a connect portion 23 extending rearwardly from the top end of the transitional portion 22, and a tail portion 24 extending downwardly from the rear end of the connect portion 23.

The spacer 30 includes a horizontal plate 31 and a vertical plate 32 extending upwardly from a rear end of the horizontal plate 31. A plurality of horizontal grooves 310 and vertical grooves 320 are defined in the upper surface of the horizontal plate 31 and in the front surface of the vertical plate 32, respectively. Each vertical groove 320 is communicated with a corresponding horizontal groove 310. The vertical grooves 320 extend downwardly throughout the bottom surface of the spacer 30. The front surface of the vertical plate 32 is formed with a protrusion 321 protruding outwardlly adjacent a middle portion thereof and configured corresponding to the cutout 151 of the flat roof 150. The spacer 30 has two recesses 311 defined in the opposite lower and outer sides thereof and two posts 33 extending downwardly from the bottom surface of the horizontal plate 31 of the spacer 30.

The inner shell 40 is generally annular and comprises a main portion 41, a upper extension 43 and a lower extension 44. The upper extension 43 extends rearwardly from the upper side of the main portion 42 and has a first spring tab 431 extending upwardly obliquely rearwardly and a second spring tab 432 extending downwardly obliquely forwardly. The lower extension 44 extends rearwardly from the lower side of the main portion 42 and then upwardly.

The outer shell 50 is stamped and formed from a metal sheet and comprises a planar top wall 51, a pair of side walls 52 extending downwardly from the opposite sides of the top wall 51 and a plurality of legs 53 extending downwardly from the lower ends of the side walls 52. Each side wall 52 comprises an aperture 521 corresponding to the projection 130 of the insulative housing 10 and a clip 54 corresponding to the recess 311 of the spacer 30.

In assembly, The terminals 20 are assembled to the insulative housing 10 with the mating portions 21 received in the terminal passageways 112 and the transitional portions 22 extending in the cavity 152. The top ends of transitional portions 22 are positioned in the spaces 154 and the connect portions 23 extend rearwardly along the bottom surface of the flat roof 150. The inner shell 40 is assembled to the insulative housing 10 with the main portion 41 received in the recess 110. The upper extension 43 is received in the notch 120 with the first spring tab 431 extending beyond the top face 12 of the insulative housing 10 and the second spring tab 432 abutting against the stop block 121 therein. The lower extension 44 is received in the notch 140 of the insulative housing 10 and a free end of the lower extension 44 engages with the gap 155 in the bottom wall of the cavity 152. A circular front edge of the inner shell 40 is rearwardly trimmed for compliance with the rearwardly curved configuration of the mating face 11 of the housing 10.

The protrusion 321 of the spacer 30 engages with the cutout 151 of the flat roof 150 for assembling the spacer 30 to the insulative housing 10. At the same time, the front surface of the horizontal plate 31 abuts against the rear face 15 of the housing 10, the upper surface of the horizontal plate 31 abuts against the bottom surface of the flat roof 150, the front surface of the vertical plate 32 abuts against the rear surface of the flat roof 150. The connect portions 23 of the terminals 20 are received in the horizontal grooves 310 of the spacer 30. The tail portions 24 of the terminals 20 are received in the vertical grooves 320 of the spacer 30 and extend beyond the bottom surface of the spacer 30 for soldering in signal plated holes 64 of a printed circuit board 60 (FIG. 5) on which the connector 1 is mounted. In this way, the tail portions 24 of the terminals 20 are positioned accurately for assuring the electrical connecting between the connector 1 and the printed circuit board 60.

Finally the outer shell 51 is assembled to the housing 10 with the top wall 51 covering the top face 12 of the insulative housing 10 and the apertures 521 receiving the projections 130. The first spring tab 431 of the inner shell 40 abuts against the inner surface of the top wall 51 of the outer shell 50 for electrically connecting between the inner shell 40 and the outer shell 50. The clips 54 bends inwardly into the recess 311 of the spacer 30 for holding the spacer 30 to the housing 10.

Figure 3:
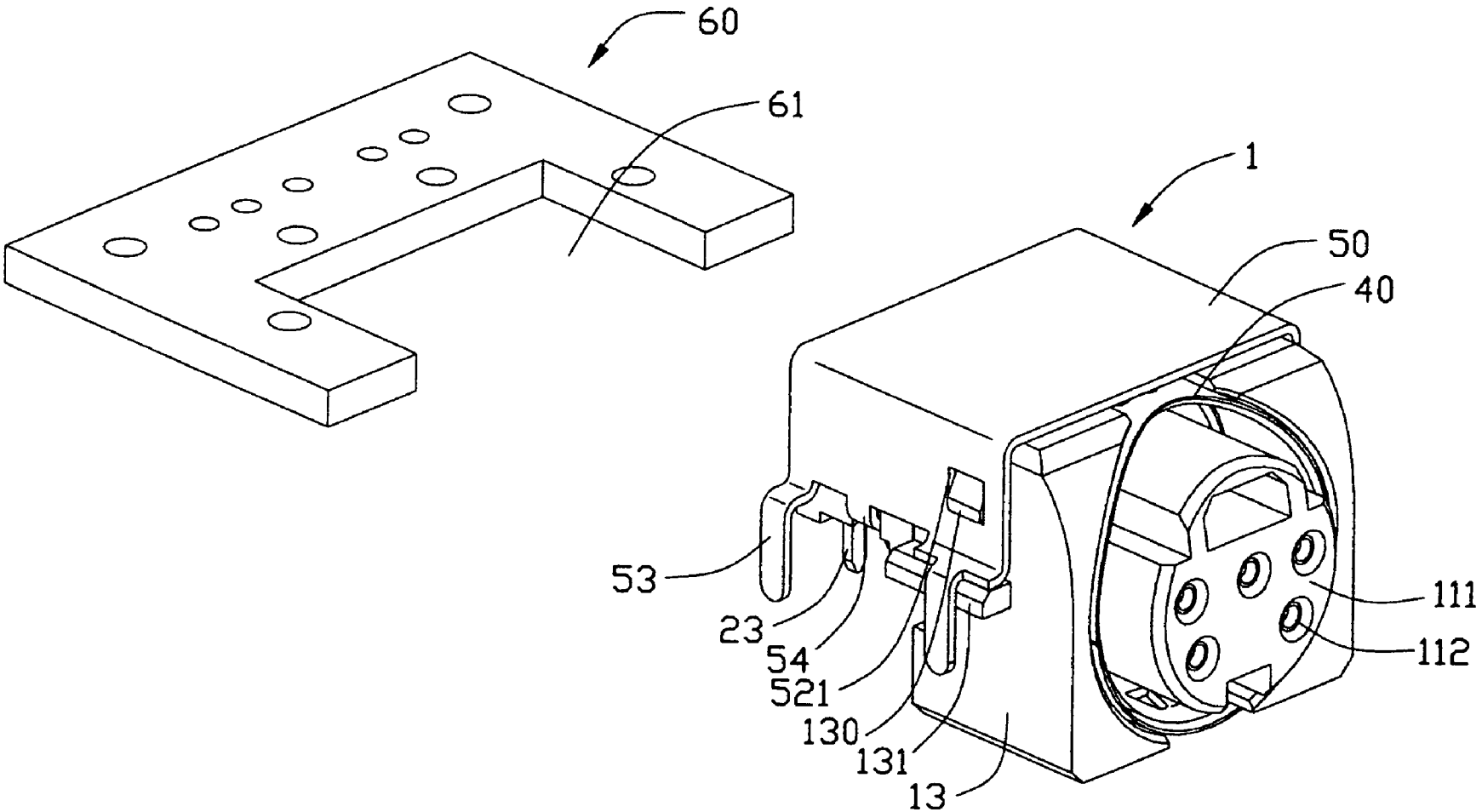
FIG. 3 is a perspective view of assembled mini DIN connector of FIG. 1 and a printed circuit board on which the mini DIN connector is mounted.
Figure 4:
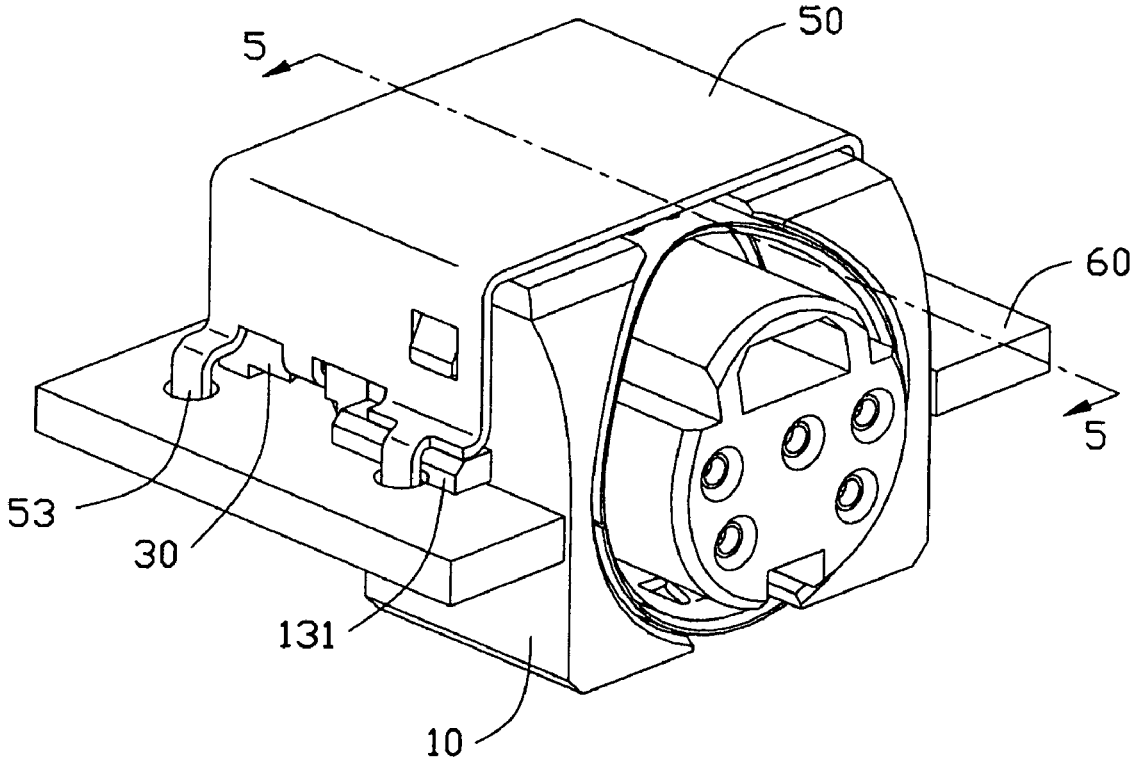
FIG. 4 is a view similar to FIG. 3 but the mini DIN connector has been secured to the printed circuit board.
Figure 5:
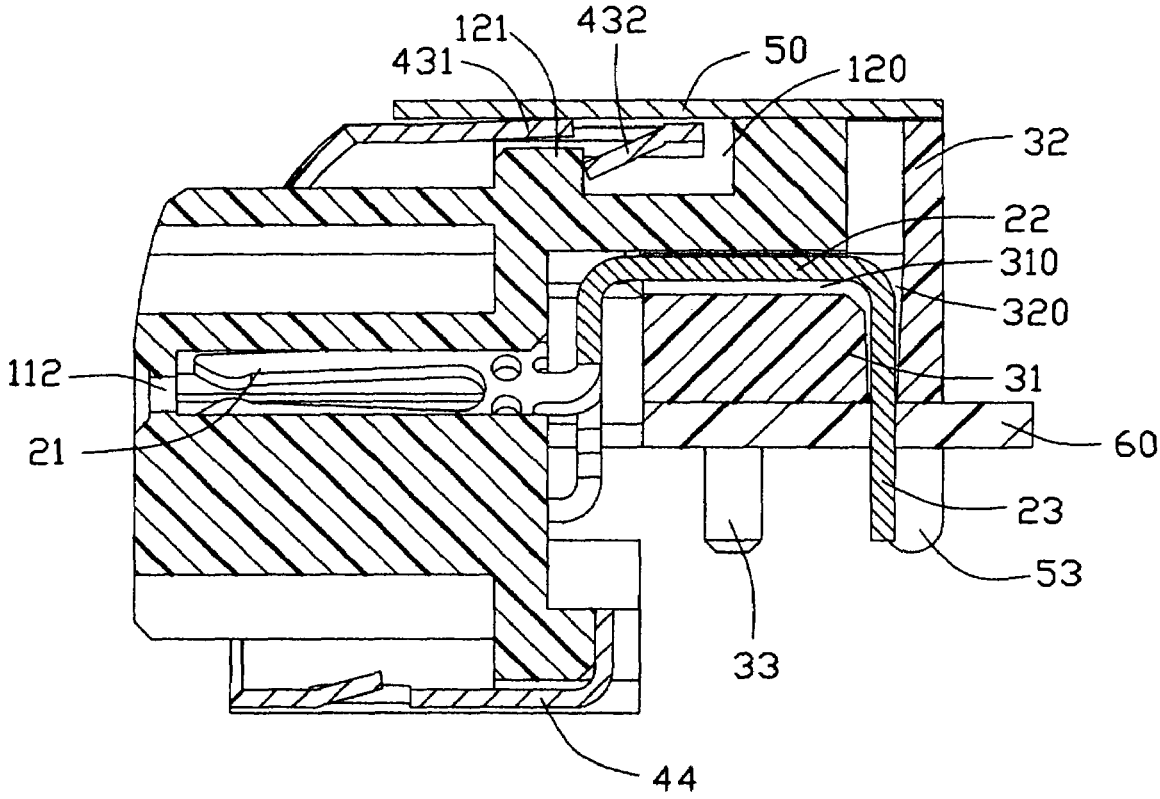
FIG. 5 is a cross-sectional view taken along line 5—5 of FIG. 4.

Referring to FIG. 3–FIG 5, the printed circuit board 60 has a opening 61 at one edge. When the connector 1 is mounted on the printed circuit board 60, the two support portions 131 in the lateral faces 13 of the housing 10 respectively stand on the upper surface of the printed circuit board beside the opposite sides of the opening 61, the spacer 30 stands on the upper surface of the printed circuit board in back of the opening 61, the two posts 33 of the spacer 30 extend into corresponding through holes 63 of the printed circuit board 60, the legs 53 of the outer shell 50 are received and soldered in grounding plated holes 62, and the free ends of the tail portions 24 of the terminals 20 are received and soldered in the signal plated holes 64 of the printed circuit board 60. Thus the lower portion of the connector 1 is located below the circuit board 60, thereby reducing the height of the connector 1 above the printed circuit board 60.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a top face, front face, and;

a columnar mating port extending forwardly beyond the front face;

a plurality of terminals disposed in the mating port;

an annular recess surrounding the mating port in the housing for receiving a shell member of a mating connector;

a tubular metallic inner shell received in the recess; and a cubic metallic outer shell enclosing the housing and mechanically and electrically engaged with the inner shell, wherein the top face defines a notch to communicate with the recess, wherein said inner shell includes a spring tab upwardly extending through said notch to engage the outer shell.

2. An electrical connector comprising:

an insulative housing defining a flat top face and a flat front face with a rearwardly curved configuration around a junction between the top face and the front face;

a columnar mating port extending forwardly beyond the front face;

a plurality of terminals disposed in the mating port;

an annular recess surrounding the mating port in the housing; and a tubular metallic inner shell received in the recess; wherein a circular front edge of the inner shell is rearwardly trimmed for compliance with the rearwardly curved configuration of the front face of the housing.

3. The electrical connector as claimed in claim 2, wherein said tubular inner shell further includes an extension extending from a rear edge of an upper portion thereof, and an inwardly trimmed portion of the front edge of said inner shell is aligned with said extension along an axial direction of said tubular inner shell.

4. The electrical connector as claimed in claim 3 wherein said extension defines a grounding tab to electrically and mechanically engage an outer shell enclosing said housing.

5. An electrical connector comprising:

an insulative housing defining a flat top face and a flat front face with a rearwardly curved configuration round a junction between the top face and the front face;

a columnar mating port extending forwardly in the housing;

a plurality of terminals disposed in the mating port;

an annular recess surrounding the mating port in the housing; and a tubular inner shell received in the recess; wherein a circular front edge of the inner shell is rearwardly trimmed for compliance with the rearwardly curved configuration of the front face of the housing.

6. The electrical connector as claimed in claim 5, wherein two support portions are located around middle portions of two side portions of the housing so as to implement a lower profile arrangement of the connector when assembled to a printed circuit board.

* * * * *